United States Patent [19]

Okuda

[11] Patent Number: 4,983,136

[45] Date of Patent: Jan. 8, 1991

[54] METHOD OF FORMING AN ELECTRON REFLECTING COAT ON CRT SHADOW MASKS

[75] Inventor: Hiroshi Okuda, Nagaokakyo, Japan

[73] Assignee: Mitsubishi Denki Kabushiki Kaisha, Tokyo, Japan

[21] Appl. No.: 371,034

[22] Filed: Jun. 26, 1989

[30] Foreign Application Priority Data

Jun. 27, 1988 [JP] Japan ..... 63-159792

[51] Int. Cl.[5] ..... H01J 29/07

[52] U.S. Cl. ..... 445/47; 427/126.3

[58] Field of Search ..... 445/47; 427/126.3

[56] References Cited

U.S. PATENT DOCUMENTS 4,442,376 4/1984 Van Der Wall et al. ..... 445/47 X
4,810,927 3/1989 Watanabe ..... 445/47 X

FOREIGN PATENT DOCUMENTS 14459 4/1985 Japan .
6969 3/1986 Japan .
295329 12/1987 Japan ..... 445/47

*Primary Examiner*—Kenneth J. Ramsey
*Attorney, Agent, or Firm*—Birch, Stewart, Kolasch & Birch

[57] ABSTRACT

A method of forming an electron reflecting layer on a perforated shadow mask in a color cathode ray tube, which method comprises the steps of preparing an aqueous suspension containing water glass and powdered bismuth oxide, applying the suspension by the use of a spraying technique to one of opposite surfaces of the perforated shadow mask which confronts a color electron gun assembly within the color cathode ray tube, thereby to form an electron reflecting coating, and drying the coating to complete the electron reflecting layer. The aqueous suspension is prepared by adding to water both the powdered bismuth oxide of 0.1 to 1.0 μm in average particle size in a quantity within the range of 20 to 45 percent by weight relative to the total weight of the aqueous suspension and the water glass having a solid component within the range of 25 to 30 percent by weight relative to the total weight of the water glass, the amount of the water glass added to the water being within the range of 37.5 to 62.5 percent by weight relative to the amount of the powdered bismuth oxide used.

8 Claims, 2 Drawing Sheets

METHOD OF FORMING AN ELECTRON REFLECTING COAT ON CRT SHADOW MASKS

BACKGROUND OF THE INVENTION

1. Field of the Invention

The present invention generally relates to a finely perforated shadow mask in a color cathode ray tube and, more particularly, to a method of forming an electron reflecting layer on the finely perforated shadow mask for facilitating reflection of electron beams thereby to minimize any possible thermal deformation of the finely perforated shadow mask.

2. Description of the Prior Art

As is well known to those skilled in the art, the color cathode ray tube generally comprises a highly evacuated envelope including a funnel section generally tapering in one direction, a generally cylindrical neck section closed at a rear end and continued at a front end to the reduced diameter end of the funnel section and accommodating therein a color electron gun assembly comprised of red, green and blue electron guns, a faceplate having its periphery sealed to the large diameter end of the funnel section and also having a screen plate. The screen plate has an inner surface deposited with a multiplicity of generally vertically running stripes of cyclically distributed, elemental color phosphors, for example, red, green and blue phosphors, which surface confronts the electron gun assembly. The evacuated envelope also includes a finely perforated shadow mask lying perpendicular to the longitudinal axis of the evacuated envelope and having a multiplicity of fine slits each provided for one group of the three elemental color phosphors on the inner surface cf the screen plate, which mask is housed within the envelope and positioned in the vicinity of and in parallel relationship with the phosphor deposited inner surface of the screen plate. The groups of the three elemental color phosphors on the inner surface of the screen plate are so defined and so positioned as to optoelectrically correspond to the slits defined in the perforated shadow mask.

FIG. 1 of the accompanying drawings schematically illustrates a longitudinal sectional view of the well known color cathode ray tube, wherein reference numeral 1 represents the highly evacuated envelope, reference numeral 2 represents the electron gun assembly, reference numeral 3 represents the finely perforated shadow mask, reference numeral 4 represents the screen plate, reference numeral 5 represents the phosphor deposited inner surface of the screen plate 4, reference numeral 6 represents a deflection yoke assembly mounted on the neck section in the vicinity of the funnel section and comprised of two pairs of electromagnetic coils disposed at right angles to each other on the neck section, reference numeral 7 represents the slits defined in the perforated shadow mask 3, and reference numeral 8 represents electron beams emitted from the electron gun assembly 2.

The color cathode ray tube of the above described construction operates in the following manner. Three electron beams 8 of different colors emitted from the color electron gun assembly 2 travel towards the phosphor deposited inner surface 5 of the screen plate 4. On their course towards the screen plate 4, the electron beams 8 are passed through a deflection magnetic field developed by the deflection yoke assembly 6 so that the electron beams can sweep across the phosphor deposited inner surface 5 of the screen plate 4 from left to right and from top to bottom while successively exciting the elemental color phosphor deposits on the inner surface 5 of the screen plate 4. After the passage of the color electron beams 8 through the deflection magnetic field, the color electron beams 8 pass through selected ones of the slits 7 in the perforated shadow mask 3. As is well known to those skilled in the art, the perforated shadow mask 3 serves as a color selection electrode operable to allow any single electron beam to impinge only upon the phosphor deposits of a particular one of the three elemental colors as the perforated shadow mask 3 is so uniquely positioned relative to the phosphor deposited inner surface 5 of the screen plate 4 as to permit any one group of the three elemental color phosphors on the inner surface 5 to correspond to the associated slits 7 in the perforated shadow mask 3.

In this well known color cathode ray tube, it is also well known that about 80% of the color electron beams produced by the color electron gun assembly 2 is said to impinge upon the perforated shadow mask 3 without passing through the slits 7 and will therefore not reach the phosphor deposited inner surface 5 of the screen plate 4. It is this quantity of the color electron beams that applies heat energies to the perforated shadow mask 3 thereby to cause the latter to be undesirably heated. Once the perforated shadow mask 3 is so heated, the perforated shadow mask undergoes an undesirable thermal expansion that results in a thermal deformation of the perforated shadow mask 3 generally known as doming. The doming phenomenon is known as a cause of a deviation in positional relationship between the elemental color phosphor deposits on the inner surface 5 of the screen plate 4 and the patterned slits 7 in the perforated shadow mask 3, that is, a cause of mislanding of the electron beams upon the phosphor deposited inner surface 5.

As a method of substantially alleviating the above discussed problem, the Japanese Patent Publication No. 61-6969, published in 1986, and U.S. Pat. No. 4,810,927 issued Mar. 7, 1989, and assigned to the same assignee of the present invention, discloses the formation of an electron reflecting layer 9 on the perforated shadow mask 3 as shown in FIG. 2 which shows a fragmentary enlarged view of a portion of the perforated shadow mask 3. According to any one of those references, the electron reflecting layer 9 is made of a material having a higher reflectivity to the incident electron beams than that of a material used to form the perforated shadow mask 3.

The Japanese Patent Publication No. 60-14459, published in 1985, and U.S. Pat. No. 4,442,376, disclose the formation of the electron reflecting layer 9 by spraying a suspension, containing a quantity of powdered heavy metal having its atomic number of 70 or greater, onto the perforated shadow mask 3 while air is drawn through the slits 7 in the perforated shadow mask 3 from a location on one side of the perforated shadow mask 3 adjacent the phosphor deposited inner surface of the screen plate 4.

One example of the heavy metal whose atomic number is 70 or greater may include a bismuth oxide. In practice, the bismuth oxide is employed in the form of powdered particles of not greater than 1 $\mu$m in particle size which are added to an aqueous solution of water glass to provide the suspension. To form the electron reflecting layer 9, a spraying technique is employed to apply the suspension containing the powdered bismuth oxide over the perforated shadow mask 3.

However, it has generally been considered difficult to realize a favorable method of forming the electron reflecting layer on the perforated shadow mask. Specifically, the application of the suspension containing the powdered bismuth oxide by the use of the spraying technique requires the content of the bismuth oxide to be properly selected to a required value in dependence on the particle size of the powdered bismuth oxide used. Unless the content of the powdered bismuth oxide is selected properly, the viscosity of the resultant suspension tends to become excessively high or low so enough as to result in a clogging of the particles within a spraying gun or as to result in a difficulty in spraying the suspension uniformly over the perforated shadow mask.

Also, if the content of the water glass used in the suspension as a binder is increased in an attempt to increase the bondability of the applied bismuth coating, that is, the eventually formed electron reflecting layer, to the surface of the perforated shadow mask, an increased amount of carbon dioxide tends to be adsorbed by the water glass, resulting in a considerable reduction of the lifetime of the perforated shadow mask in the color cathode ray tube. On the other hand, if the content of the water glass in the suspension is short of the required quantity, an insufficient bondability will be attained between the electron reflecting layer and the perforated shadow mask and the electron reflecting layer will be readily peeled off from the perforate shadow mask.

SUMMARY OF THE INVENTION

Accordingly, the present invention has been devised with a view to substantially eliminating the above discussed problems inherent in the prior art method of forming the electron reflecting layer on the perforated shadow mask and has for its primary object to provide an improved method of the type referred to, which is effective to facilitate the use of the spraying technique to apply the suspension to a uniform thickness thereby to form the electron reflecting layer of uniform thickness on the perforated shadow mask with no clogging substantially occurring in the spraying gun.

Another important object of the present invention is to provide an improved method of the type referred to above, which is effective to form the rigid electron reflecting layer hard to separate from the perforated shadow mask and which emits a minimized quantity of obnoxious gases during the execution of the method and is, therefore, effective to avoid any possible reduction of the lifetime of the perforated shadow mask in the color cathode ray tube.

In order to accomplish the above described objects, the present invention provides a method of forming an electron reflecting layer on a perforated shadow mask, which method comprises a step of preparing an aqueous suspension containing water glass and powdered bismuth oxide, a step of applying the suspension to one of opposite surfaces of the perforated shadow mask which confronts a color electron gun assembly within an envelope of the color cathode ray tube, thereby to form an electron reflecting coating, and a step of drying the coating to complete the electron reflecting layer. The application of the aqueous suspension to said one of the opposite surfaces of the perforated shadow mask may be carried out by the use of a spraying technique.

In the practice of the method of the present invention, it is essential that the suspension be prepared by adding to water, for example, either distilled water or pure water, both the powdered bismuth oxide of 0.1 to 1.0 $\mu$m in average particle size in a quantity within the range of 20 to 45 percent by weight relative to the total weight of the aqueous suspension and the water glass having a solid component within the range of 25 to 30 percent by weight relative to the total weight of the water glass, the amount of said water glass added to the water being within the range of 37.5 to 62.5 percent by weight relative to the amount of the powdered bismuth oxide used.

According to the present invention, by selecting the content and the average particle size of the powdered bismuth oxide in the suspension and the mixing ratio of the powdered bismuth oxide and the water glass in the suspension, the resultant suspension for use in the formation of the electron reflecting layer on the perforated shadow mask can have a proper viscosity enough to permit it to be sprayed onto the perforated shadow mask to a uniform thickness. Also, the electron reflecting layer so formed on the perforated shadow mask can exhibit a proper bondability to the perforated shadow mask and, therefore, the possibility of the electron reflecting layer to be peeled off from the perforated shadow mask can be minimized. In addition, any possible emission of obnoxious gases during the operation of the color cathode ray tube using the electron reflecting layer formed on the perforated shadow mask in accordance with the method of the present invention can also be minimized thereby to substantially avoid the reduction in lifetime of the perforated shadow mask in the color cathode ray tube.

With the employment of the particular aqueous suspension prepared in the manner as hereinabove described, the method of the present invention is effective to provide the relatively thin electron reflecting layer on the perforated shadow mask, with no substantial difficulty in workability. Moreover, the electron reflecting layer so formed by the method of the present invention can exhibit a sufficient bondability or interlocking property relative to the perforated shadow mask, with minimized possibility of fragments of the electron reflecting layer peeled off from the perforated shadow mask.

BRIEF DESCRIPTION OF THE DRAWINGS

In any event, the present invention will become more clearly understood from the following description of a preferred embodiment thereof, when taken in conjunction with the accompanying drawings. However, the embodiment and the drawings are given only for the purpose of illustration and explanation, and are not to be taken as limiting the scope of the present invention in any way whatsoever, which scope is to be determined solely by the appended claims. In the accompanying drawings, like reference numerals are used to denote like parts throughout the several views, and:

DETAILED DESCRIPTION OF THE EMBODIMENTS

Figure 1:
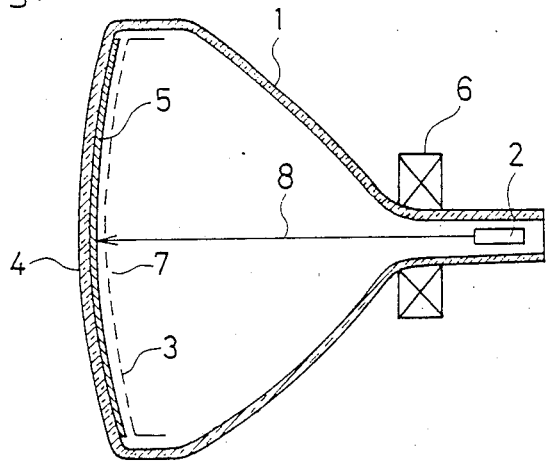
FIG. 1 is a schematic longitudinal sectional view of the commercially available color cathode ray tube to which the present invention is applicable.
Figure 2:
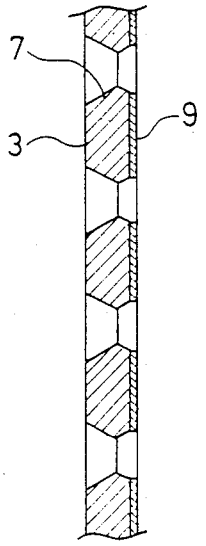
FIG. 2 is a fragmentary sectional view, on an enlarged scale, of a portion of the perforated shadow mask used in the color cathode ray tuba, showing the formation of an electron reflecting layer on the perforated shadow mask.

As hereinbefore discussed, with reference to FIG. 2, the present invention provides a method of forming an electron reflecting layer 9 on a perforated shadow mask 3 used in a highly evacuated envelope of a color cathode ray tube substantially as shown in FIG. 1. According to the method of the present invention, the electron reflecting layer 9 is formed by spraying, onto one of the opposite surfaces of the perforated shadow mask confronting the color electron gun assembly 2, an aqueous suspension containing 20 to 45 percent by weight, preferably 30 to 40 percent by weight, of the powdered bismuth oxide of 0.1 to 1.0 μm in average particle size relative to the total weight of the aqueous suspension and 37.5 to 62.5 percent by weight, preferably 40.0 to 62.5 percent by weight, of the water glass relative to the total weight of the powdered bismuth oxide employed. The water glass used must be of a type containing a solid component in a quantity within the range of 25 to 30 percent by weight relative to the total weight of the water glass used. The aqueous suspension applied onto the specific surface of the perforated shadow mask 3 is subsequently dried to complete the formation of the electron reflecting layer 9.

To dry the applied aqueous suspension to complete the formation of the electron reflecting layer 9, any suitable drying method may be employed, however, the use of either natural drying or forced drying is preferred. The natural drying may be carried out by allowing the perforated shadow mask having the coating of the aqueous suspension on one specific surface thereof to stand in a clean room, and the forced drying may be carried out by heating the perforated shadow mask having the coating of the aqueous suspension on one specific surface thereof to a predetermined temperature not higher than 450° C.

Hereinafter, the present invention will be demonstrated by way of some examples which are not to be understood as limitative of the scope of the present invention, but are presented only for the purpose of illustration.

EXAMPLE I 1,875 cc of water glass of sodium silicate type containing 27.5% of solid component and 3 Kg of bismuth oxide particles of 0.1 μm in average particle size were added to and uniformly mixed in 3.5 l of distilled water to provide the aqueous suspension necessary to form the electron reflecting layer. In this aqueous suspension, the amount of the water glass relative to the total weight of the powdered bismuth oxide ($Bi_2O_3$) was 62.5 percent by weight and the content of the powdered bismuth oxide relative to the total weight of the aqueous suspension was 33.9 percent by weight.

An appropriate quantity of the aqueous suspension so prepared was then applied to one surface of the perforated shadow mask uniformly over the entire surface thereof and subsequently dried by allowing it to stand in a room, thereby to complete the formation of the electron reflecting layer.

A color cathode ray tube was assembled using the perforated shadow mask having the electron reflecting layer formed in the manner as hereinabove described and was then tested as to its performance. The test result has indicated that the electron reflecting layer exhibited a sufficient bondability to the perforated shadow mask without the lifetime thereof having not been adversely affected and also minimized color displacement having been found.

EXAMPLE II 1,125 cc of water glass of potassium silicate type containing 28.0% of solid component and 3 Kg of bismuth oxide particles of 1.0 μm in average particle size were added to and uniformly mixed in 3.5 l of distilled water to provide the aqueous suspension necessary to form the electron reflecting layer. In this aqueous suspension, the amount of the water glass relative to the total weight of the powdered bismuth oxide ($Bi_2O_3$) was 37.5 percent by weight and the content of the powdered bismuth oxide relative to the total weight of the aqueous suspension was 37.9 percent by weight.

An appropriate quantity of the aqueous suspension so prepared was then applied to one surface of the perforated shadow mask uniformly over the entire surface thereof and subsequently dried by allowing it to stand in a room, thereby to complete the formation of the electron reflecting layer.

A color cathode ray tube was assembled using the perforated shadow mask having the electron reflecting layer formed in the manner as hereinabove described and was then tested as to its performance. The test result has indicated an effect similar to that under EXAMPLE I.

EXAMPLE III 1,070 cc of water glass of sodium silicate type containing 27.5% of solid component, 120 cc of water glass of potassium silicate type containing 28.0% of solid component and 3 Kg of bismuth oxide particles of 0.5 μm in average particle size were added to and uniformly mixed in 3.5 l of distilled water to provide the aqueous suspension necessary to form the electron reflecting layer. In this aqueous suspension, the amount of the water glass relative to the total weight of the powdered bismuth oxide ($Bi_2O_3$) was 40.0 percent by weight and the content of the powdered bismuth oxide relative to the total weight of the aqueous suspension was 37.6 percent by weight.

An appropriate quantity of the aqueous suspension so prepared was then applied to one surface of the perforated shadow mask uniformly over the entire surface thereof and subsequently dried by allowing it to stand in a room, thereby to complete the formation of the electron reflecting layer.

A color cathode ray tube was assembled using the perforated shadow mask having the electron reflecting layer formed in the manner as hereinabove described and was then tested as to its performance. The test result has indicated an effect similar to that under any one of EXAMPLE I and EXAMPLE II.

It is to be noted that, in any one of the foregoing EXAMPLES, the drying of the coating of the aqueous suspension on the perforated shadow mask has been described as carried out by allowing the perforated shadow mask with the suspension coating thereon to stand in a room. However, heating may be employed to dry the suspension coating to complete the electron reflecting layer and, in such case, the heating may be effected for a predetermined length of time at a temperature not higher than 450° C., for example, 30 minutes at 440° C.

As regards the average particle size of the powdered bismuth oxide, the smaller the average particle size, the better. However, by the following reason, the average particle size within the range of 0.1 to 1.0 μm is chosen in the practice of the method of the present invention.

The conventional wet-type milling machine generally used to milling a medium into a powder, which is generally referred to as a ball mill, tends to take about 24 to 72 hours of operation to mill the bismuth oxide to an average particle size of 2 to 3 μm and cannot be practically satisfactorily used to mill it to the smaller average particle size. However, the milling of the bismuth oxide to an average particle size equal to or smaller than 1.0 μm can be effectively accomplished when a wet-type pulverizer commercially available under a tradename "AQUAMIZER" from Hosokawa Micron Kabushiki Kaisha of Japan is employed.

However, even with the commercially available wet-type pulverizer referred to above, it takes a relatively great length of time to mill the bismuth oxide to an average particle size smaller than 0.1 μm and, therefore, the commercially available wet-type cannot be practically satisfactorily used to make the powdered bismuth oxide having an average particle size smaller than 0.1 μm while no other effective means for making the powdered bismuth oxide having the average size smaller than 0.1 μm on an industrial scale appears not to be readily available.

A series of experiments similar to the foregoing were carried out with the average particle size D varied and also with a varying content (percentage by weight) of the water glass employed relative to a varying amount of the powdered bismuth oxide. Results of those experiments are shown in the respective graphs of FIGS. 3 and 4.

Figure 3:
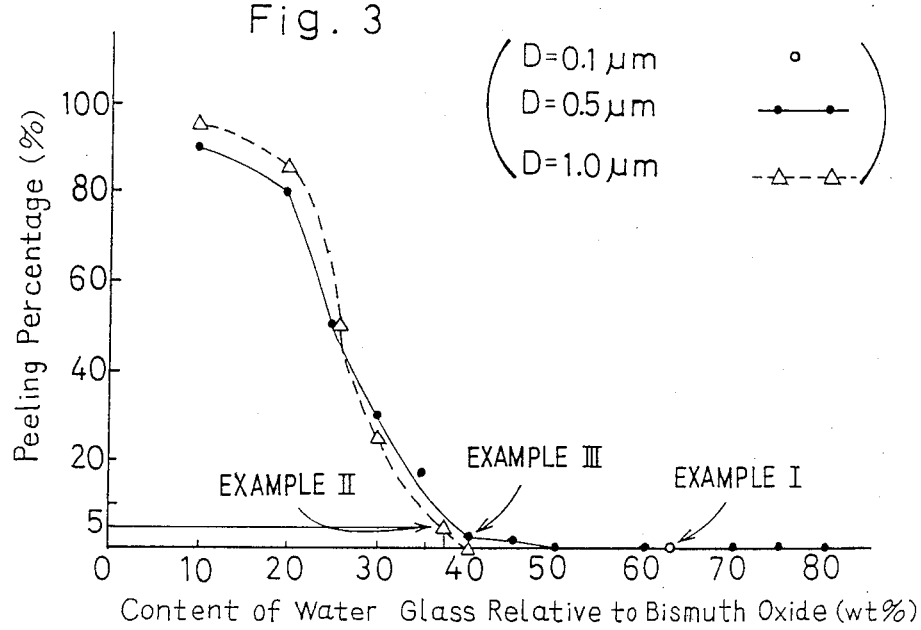
FIG. 3 is a graph showing the result of a peeling test relative to the varying amount of water glass relative to bismuth oxide employed in the suspension used to form the electron reflecting layer on the perforated shadow mask according to the present invention.

More specifically, the graph of FIG. 3 illustrates results of peeling tests, wherein the axis of abscissas represents the ratio of the weight of the water glass containing 28.7% of solid component relative to the weight of the powdered bismuth oxide and the axis of ordinates represents the percentage of the total surface area of fragments of the electron reflecting layer which have been peeled off from the perforated shadow mask relative to the surface area of the complete electron reflecting layer, which percentage is hereinafter referred to as the peeling percentage.

The peeling test which led to the results shown in the graph of FIG. 3 was conducted by applying a length of commercially available one-sided adhesive tape exteriorly on the electron reflecting layer and then peeling the length of one-sided adhesive tape off from the electron reflecting layer. If the peeling percentage is not greater than 5 percent, the electron reflecting layer can be considered as practically acceptable.

From the graph of FIG. 3, it will readily be understood that, even though the bismuth oxide particles of 0.1 to 1.0 μm in average particle size D is employed as one of the constituents of the aqueous suspension, the bondability of the electron reflecting layer to the perforated shadow mask makes no substantial difference and, therefore, the use of the water glass in a quantity not smaller than 37.5 percent by weight relative to the total weight of the powdered bismuth oxide is advisable in the practice of the method of the present invention. The use of the water glass in a quantity not smaller than 40.0 percent by weight relative thereto is more preferred in view of the fact that the peeling percentage will result in not greater than 3 percent.

Figure 4:
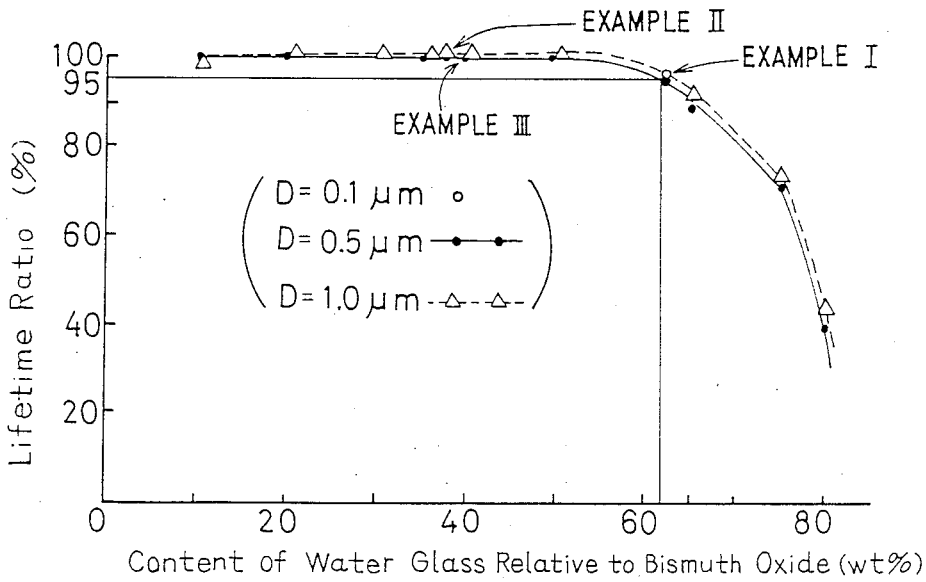
FIG. 4 is a graph showing the lifetime of a color cathode ray tube relative to the varying amount of the water glass relative to bismuth oxide employed in the suspension used to form the electron reflecting layer on the perforated shadow mask according to the present invention.

FIG. 4 illustrates how the lifetime of the color cathode ray tube employing the electron reflecting layer formed on the perforated shadow mask according to the method of the present invention is affected relative to the ratio of the weight of the water glass containing 28.7% of solid component relative to the weight of the powdered bismuth oxide. While the axis of ordinates of the graph of FIG. 4 represents the ratio of the content of the specific water glass relative to the content of the powdered bismuth oxide, the axis of abscissas represents the ratio of the lifetime of the color cathode ray tube employing the electron reflecting layer formed according to the method of the present invention relative to that of the commercially available standard color cathode ray tube.

From the graph of FIG. 4, it will readily be understood that, even though the bismuth oxide particles of 0.1 to 1.0 μm in average particle size D is employed as one of the constituents of the aqueous suspension, the lifetime of the color cathode ray tube makes no substantial difference and, therefore, the use of the water glass in a quantity not greater than 62.5 percent by weight relative to the total weight of the powdered bismuth oxide is advisable in the practice of the method of the present invention.

With respect to the solid component of the water glass, 25 to 30 percent by weight relative to the total weight of the water glass is practical, for the reason that the water glass having that percent of the solid component shows viscosity appropriate for handling to make the suspension to be sprayed on the shadow mask and also it is commonly used in other manufacturing process of the cathode ray tube, for example, sealing off the neck portion with the funnel portion using the water glass.

With respect to the workability during the spraying of the aqueous suspension onto the surface of the perforated shadow mask and the possibility of occurrence of clogging of apertures in the perforated shadow mask with the applied aqueous suspension, the both tend to be noticeably affected by the content of the powdered bismuth oxide in the aqueous suspension and, therefore, the careful selection of the content of the powdered bismuth oxide is essential. More specifically, it has been found that, as far as the ratio, based on percent by weight, of the content of the water glass relative to the content of the powdered bismuth oxide is within the range given by the results shown in FIGS. 3 and 4 will bring about no substantial adverse influence on the workability as well as the occurrence of clogging and the average particle size D of the powdered bismuth oxide will also bring about no substantial adverse influence on the both.

Hereinafter, the reason for the limitation of the content of the powdered bismuth oxide within the range of 20 to 40 percent by weight will now be discussed.

If the content of the powdered bismuth oxide is not greater than 20 percent by weight relative to the total weight of the aqueous suspension, the smaller content of the powdered bismuth oxide results in a progressively uneven distribution of $Bi_2O_3$ particles in the resultant electron reflecting layer. It has been found that, when the aqueous suspension is additionally applied to an increased thickness to compensate for the uneven distribution, the possibility of occurrence of the clogging of the apertures in the perforated shadow mask has been increased.

The use of the powdered bismuth oxide in a quantity within the range of 30 to 45 percent by weight has exhibited a favorable result. However, the use of the powdered bismuth oxide in a quantity not greater than 30 percent by weight tends to give a result which progressively approaches to that exhibited when the content of the powdered bismuth oxide used is not greater than 20 percent by weight as discussed above, when the content of the powdered bismuth oxide decreases from 30 down to 20 percent by weight. And the selection of 20 percent by weight as the smallest permissible content is critical in the practice of the method of the present invention.

On the other hand, as the content of the powdered bismuth oxide used exceeds 45 percent by weight, it has been found that the viscosity of the resultant aqueous suspension increases correspondingly, resulting in a correspondingly increased possibility of occurrence of the clogging of the apertures in the perforated shadow mask with particles in the applied aqueous suspension.

By the reason discussed hereinabove, the use of the powdered bismuth oxide in a quantity within the range of 20 to 40 percent by weight relative to the total weight of the resultant aqueous suspension is critical in the practice of the method of the present invention.

Although the present invention has been fully described in connection with the preferred embodiment thereof with reference to both the specific examples and the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the spirit and scope of the present invention as delivered from the claims annexed hereto, to be construed as included therein.

What is claimed is:

1. A method of forming an electron reflecting layer on a perforated shadow mask in a color cathode ray tube having a color electron gun assembly, which method comprises the steps of:

preparing an aqueous suspension containing 20 to 45 percent by weight of powdered bismuth oxide of 0.1 to 1.0 μm in average particle size relative to the total weight of the resultant aqueous suspension and 37.5 to 62.5 percent by weight of water glass relative to the total weight of the powdered bismuth oxide employed, said water glass containing a solid component in a quantity within the range of 25 to 30 percent by weight relative to the total weight of the water glass used;

applying the resultant aqueous suspension onto one of opposite surfaces of the perforated shadow mask which confronts the color electron gun assembly; and drying a coating of the aqueous suspension on the surface of the perforated shadow mask to complete the electron reflecting layer.

2. The method as claimed in claim 1, wherein the content of the powdered bismuth oxide in the aqueous suspension is within the range of 30 to 45 percent by weight relative to the total weight of &he aqueous suspension.

3. The method as claimed in claim 1, wherein the content of the water glass is within the range of 40.0 to 62.5 percent by weight relative to the total weight of the powdered bismuth oxide.

4. The method as claimed in claim 1, wherein the drying step is carried out by allowing the coating of the applied aqueous suspension to stand exposed to the atmosphere.

5. The method as claimed in claim 1, wherein the drying step is carried out by heating the coating of the applied aqueous suspension to a temperature not higher than 450° C.

6. The method as claimed in claim 5, wherein the resultant aqueous suspension is sprayed on to one of opposite surfaces of the perforated shadow mask which confronts the color electron gun assembly.

7. The method as claimed in claim 1, wherein the content of the powdered bismuth oxide in the aqueous suspension is within the range of 30 to 40 percent by weight relative to the total weight of the aqueous suspension.

8. The method as claimed in claim 2, wherein the content of the water glass is within the range of 40.0 to 62.5 percent by weight relative to the total weight of the powdered bismuth oxide.

* * * * *